US005445550A

United States Patent [19]

Xie et al.

[11] Patent Number: 5,445,550

[45] Date of Patent: Aug. 29, 1995

[54] LATERAL FIELD EMITTER DEVICE AND METHOD OF MANUFACTURING SAME

[76] Inventors: Chenggang Xie, 415 Cripple Creek Rd., Cedar Park, Tex. 78613; Nalin Kumar, 12116 Scribe Dr., Austin, Tex. 78727

[21] Appl. No.: 173,739

[22] Filed: Dec. 22, 1993

[51] Int. Cl.[6] ..... H01J 9/02

[52] U.S. Cl. ..... 445/24; 445/50

[58] Field of Search ..... 313/306, 309, 351, 336; 445/24, 50, 51; 156/656, 657

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt | 313/309 |
| 3,970,887 | 7/1976 | Smith et al. | 313/309 |
| 3,998,678 | 12/1976 | Fukase et al. | 156/3 |
| 4,307,507 | 12/1981 | Gray et al. | 29/580 |
| 4,663,559 | 5/1987 | Christensen | 313/336 |
| 4,710,765 | 12/1987 | Ohkoshi et al. | 340/781 |
| 4,780,684 | 10/1988 | Kosmahl | 330/54 |
| 4,827,177 | 5/1989 | Lee et al. | 313/306 |
| 4,857,161 | 8/1989 | Borel et al. | 204/192 |
| 4,857,799 | 8/1989 | Spindt et al. | 313/495 |
| 4,900,584 | 2/1990 | Tuenge et al. | 427/66 |
| 4,923,421 | 5/1990 | Brodie et al. | 445/24 |
| 4,940,916 | 7/1990 | Borel et al. | 313/306 |
| 4,943,343 | 7/1990 | Bardai et al. | 156/643 |
| 4,956,574 | 9/1990 | Kane | 313/306 |
| 4,964,946 | 10/1990 | Gray et al. | 156/643 |
| 4,983,469 | 1/1991 | Huzino et al. | 428/690 |
| 4,987,007 | 1/1991 | Wagal et al. | 427/53.1 |
| 4,987,339 | 1/1991 | Robertson et al. | 313/512 |
| 4,990,766 | 2/1991 | Simms et al. | 250/213 |
| 5,015,912 | 5/1991 | Spindt et al. | 313/495 |
| 5,019,748 | 5/1991 | Appelberg | 315/169 |
| 5,037,709 | 8/1991 | Tomomura et al. | 428/690 |
| 5,043,715 | 5/1991 | Kim et al. | 340/781 |
| 5,047,686 | 9/1991 | Robertson | 313/503 |
| 5,066,883 | 11/1991 | Yoshioka et al. | 313/309 |
| 5,089,742 | 2/1992 | Kirkpatrick et al. | 313/351 |
| 5,098,737 | 3/1992 | Collins et al. | 427/53.1 |
| 5,101,137 | 3/1992 | Kun et al. | 313/509 |
| 5,180,951 | 1/1993 | Dworksy et al. | 315/169.3 |
| 5,192,240 | 3/1993 | Komatsu | 445/24 |
| 5,199,918 | 4/1993 | Kumar | 445/50 |
| 5,266,155 | 11/1993 | Gray | 156/651 |

OTHER PUBLICATIONS

R. J. Noer, "Electron Field Emission from Broad Area Electrodes", *Applied Physics* A 28, pp. 1–24 (1982).

R. Gomer, Field Emission and Field Ionization, Harvard Univ. Press, pp.1–11, 20–37, 42–45 and 52–63, (1961).

H. Busta, et al.., "Field Emission from Tungsten-clad Silicon Pyramids", *IEEE Transactions on Electrical Devices*, vol. 36, No., 11, pp. 2679–2685 (Nov. 1989).

H. Kosmahl, "A Wide-Bandwidth High-Gain Small--Size Distributed Amplifier with Field-Emission Triodes (FETRODE's) for the 10 to 300 GHz Frequency Range", *IEEE Transactions on Electron Devices*, Vol. 36, No. 11, pp. 2728–2737 (Nov. 1989).

U.S. Application Ser. No. 07/993,863, filed Dec. 23, 1992, entitled "Triode Structure Flat Panel Display Employing Flat Field Emission Cathode."

U.S. Application Ser. No. 08/147,700, Filed Nov. 4, 1993, entitled "Method For Fabricating Flat Panel Display Systems And Components."

A. Kaneko, "Field Emitter Array with Lateral Wedges", *Technical Digest of the International Vacuum Microelectronics Conference*, Nagahama 1991, pp. 50–51.

R. Meyer et al., "Recent Development on 'Microtips' Display at LETI", *Technical Digest of the International Vacuum Microelectronics Conference*, Nagahama 1991, pp. 6–9.

(List continued on next page.)

*Primary Examiner*—Kenneth J. Ramsey

[57] ABSTRACT

Lateral luminescent field emitter devices for use in flat panel displays and a method of manufacturing are described. The device comprises a flat substrate, an anode disposed on the substrate, and a cathode disposed on the substrate, the cathode providing an electron emission surface capable of emitting electrons laterally across a gap to a major portion of an adjacent surface of the anode.

15 Claims, 8 Drawing Sheets

OTHER PUBLICATIONS

V. Makhov, "Field Emission Cathode Technology and it's Application", *Technical Digest of the International Vacuum Microelectronics Conference,* Nagahama 1991, pp. 40–43.

J. Itoh, et al., "Metal-Film-Edge Field Emitter Array With a Self-Aligned Gate", *Technical Digest of the International Vacuum Microelectronics Conference,* Nagahama 1991, pp. 46–47.

S. Kanemaru et al., "Fabrication and Characterization of Lateral Field-Emitter Triodes", *IEEE Transactions on Electron Devices,* vol. 38, No. 10, Oct. 1991, pp. 2334–2336.

A. Kaneko et al., "Wedge-Shaped Field Emitter Arrays for Flat Display", *IEEE Transactions on Electron Devices,* vol. 38, No. 10, Oct. 1991, pp. 2395–2397.

LATERAL FIELD EMITTER DEVICE AND METHOD OF MANUFACTURING SAME

BACKGROUND OF THE INVENTION

1. Field of the Invention

The invention relates to field emitters, and more particularly to lateral luminescent field emitter devices in flat panel displays.

2. Description of Related Art

There are several means by which electrons may be emitted from a material by increasing the energy of electrons at the material surface so that the energy exceeds a certain energy potential barrier. For example, thermionic emission uses heat, photoemission uses radiation such as light, and secondary emission uses charged particles such as electrons or ions to increase the electron energy level at the emission surface. Electron emission by such means has been used for cathode ray tubes in television sets for example.

Field emission devices ("FED's") liberate electrons by lowering the potential barrier at a conductive emission surface rather than by raising the electron energy. In accordance with the probabilities of quantum mechanics, although the energy of electrons in a conductive material does not exceed the potential barrier at the conductor surface nevertheless a certain portion of those electrons will tunnel through that potential barrier to be emitted at the surface. An electrical field may be employed to narrow the potential barrier so that an increasing portion of the electrons are emitted, thereby increasing field emission current. Such FED's have been used for purposes such as electron microscopes and flat panel displays. They have been extensively studied and are well known in the art. See, for example, R. J. Noer, "Electron Field Emission from Broad Area Electrodes", *Applied Physics* A 28, pp. 1–24 (1982).

FED's have a number of limitations which restrict their usefulness. One limitation concerns the energy level imparted to the electrons after they are emitted. Another limitation concerns the uniformity of emission current. The mechanisms and tradeoffs of these and other limitations will be further explained in the following discussion.

One limitation concerns ionization due to electron energy. The energy which the electric field imparts to electrons after emission may reach a level that causes gases surrounding the electron emission surface to ionize. Such ionized gases may in turn damage the emission surface and impair further emission. See, for example, U.S. Pat. No. 3,970,887, by D. Smith, et al., entitled "Micro-Structure Field Emission Electron Source" (discussing shortened life due to ionization). Therefore, to reduce the required electrical field and thereby reduce the amount of ionization, typical FED's use low "work function" materials for the emission surface, that is, special materials that emit electrons at relatively low energy levels. R. Gomer, FIELD EMISSION AND FIELD IONIZATION, Harvard Univ. Press, pp. 3–4 (1961); see also, U.S. Pat. No. 4,663,559, by A. Christensen, entitled "Field Emission Device".

The electrical field required for emission may also be reduced by shaping the emission surface so that the field is concentrated into a small region. See, for example, U.S. Pat. No. 3,998,678, by S. Fukase, et al., entitled "Method of Manufacturing Thin-Film Field Emission Electron Source" (conical tips); U.S. Pat. No. 4,663,559, by A. Christensen, entitled "Field Emission Device" ("whiskers" in prior art and particles in the Christensen device); and U.S. Pat. No. 5,066,883, by S. Yoshioka, et al., entitled "Electron-Emitting Device with Electron-Emitting Region Insulated from Electrodes" (thin film with cracks); and U.S. Pat. No. 5,089,742, by D. Kirkpatrick, et al., entitled "Electron Beam Source Formed with Biologically Derived Tubule Materials" (micro-protrusions); V. Makhov, "Field Emission Cathode Technology and its Application", *Technology Digest of IVMC* 91, Nagahama 1991 (edge of film). This results in emission at an applied voltage lower than the voltage required for a reference configuration with flat shapes, thereby defining a "field enhancement factor". See H. Busta, et al., "Field Emission from Tungsten-Clad Silicon Pyramids", *IEEE Transactions on Electron Devices,* Vol. 36, No. 11, pg. 2679 (November 1989).

One drawback of concentrating the field in a small region is that the current emission is also limited to a small region resulting in a low current, high density electron beam. See U.S. Pat. No. 3,755,704, by C. Spindt, et al., entitled "Field Emission Cathode Structures and Devices Utilizing Such Structures" (discussing techniques to provide multiple points for parallel currents in order to increase total current available). And the typical sharp pointed emitters also suffer from uniformity limitations. See H. Kosmahl, "A Wide-Bandwidth High-Gain Small-Size Distributed Amplifier with Field-Emission Triodes (FETRODE's) for the 10 to 300 GHz Frequency Range", *IEEE Transactions on Electron Devices,* Vol. 36, No. 11, pg. 2728 (November 1989) (explaining that sharp pointed structures do not provide uniform emission currents from one device to the next, and discussing how the variation relates to topography). Thus, such beams are not ideally suited for producing luminesence over a large area.

Besides using low work function material and field enhancing shapes to reduce the required electrical field for electron emission, FED's typically employ a small separation between the emission electrode and the accelerator electrode (i.e., "field electrode", or "gate") which produces the liberating electrical field. In this manner the electrical field is increased without increasing the voltage driving the field so that less energy is imparted to the electrons after emission. One means for providing such a small separation involves etching a laminate structure with a first electrode on a flat substrate, a thin dielectric layer over the first electrode, and a second electrode layer over the dielectric so that the bottom electrode is exposed in close proximity to the top electrode. See, for example, U.S. Pat. No. 4,307,507, by H. Gray, et al., entitled "Method of Manufacturing a Field-Emission Cathode Structure"; U.S. Pat. No. 4,943,343, by Z. Bardai, et al., entitled "Self- Aligned Gate Process for Fabricating Field Emitter Arrays"; and U.S. Pat. No. 4,964,946, by H. Gray, et al., entitled "Process for Fabricating Self-Aligned Field Emitter Arrays"; U.S. Pat. No. 5,066,883, by S. Yoshioka, et al., entitled "Electron-Emitting Device with Electron-Emitting Region Insulated from Electrodes". Another means for providing a small separation between electrodes involves etching a buffer layer between electrodes on the same substrate to provide lateral electron emission. See, for example, Makhov, "Field Emission Cathode Technology and its Application", *Technical Digest of IVMC* 91, Nagahama 1991; S. Bandy, "Thin Film Emitter Development", *Technical Digest of IVMC* 91, Nagahama 1991.

There are tradeoffs involved in lowering the voltage required to produce electron emission. It is desirable to reduce the voltage not only in order to reduce gas ionization, but also because it increases frequency response by reducing the time required to bring the field electrode up to the required emission voltage. As described above, reducing the separation between the emission electrode and the field electrode helps to reduce the required voltage; however, a decreasing separation has the undesireable side effect of increasing sensitivity of the FED emission current to small variations in electrode separation. FED current density may change by as much as 10% for a 1% change in electrode separation. Furthermore, although it is desirable to lower the energy level imparted to emitted electrons in order to preserve the emission surface, it is also desirable to impart a relatively high energy level to the electrons so that they may deliver more energy to generate more light in a display for example. Higher energy is especially needed where the total emission current is limited by current density when field enhancing shapes are employed. See U.S. Pat. No. 3,665,241, by C. A. Spindt, et al., entitled "Field Ionizer and Field Emission Cathode Structures and Methods of Production" (discussing low current because of the minute size of a sharp pointed emitting area, and low energy because of the small separation between emitter and accelerator electrodes). Thus to raise the allowable operating voltage and limit ionization damage to emission surfaces a high vacuum is typically employed. See, for example, U.S. Pat. No. 4,663,559, by A. Christensen, entitled "Field Emission Device" (discussing typical vacuum operation).

To accommodate these tradeoffs FED's have typically been triode arrangements wherein a high voltage anode is employed above a field (i.e., "accelerator") electrode. In these devices a low voltage field electrode is placed on the same substrate in a layer above the emission surface electrode. A small separation between the emitter ("cathode") and field electrodes may thus be precisely controlled so that emission occurs uniformly and at a low voltage. A higher voltage electrode ("anode") is then provided on another substrate aligned above the first. See, for example, U.S. Pat. No. 5,066,883, by S. Yoshioka, et al., entitled "Electron-Emitting Device with Electron-Emitting Region Insulated from Electrodes" (for example FIG. 3B indicating electron emission 7 toward a third electrode not shown); U.S. Pat. No. 4,780,684, by H. Kosmahl, entitled "Microwave Integrated Distributed Amplifier with Field Emission Triodes" (conical or pyramid shaped emitters in triode structure); and H. Kosmahl, "A Wide-Bandwidth High-Gain Small-Size Distributed Amplifier with Field-Emission Triodes (FETRODE's) for the 10 to 300 GHz Frequency Range", *IEEE Transactions on Electron Devices,* Vol. 36, No. 11, pg. 2728 (November 1989).

Although emission current uniformity is increased by providing a low voltage field electrode precisely located nearby the cathode, nevertheless, in these triode FED's spacing between the anode and cathode is still very important. Variations in anode-cathode spacing may cause image distortion and non-uniform brightness in flat panel displays. Spacers used to secure the anode-cathode separation may permit leakage current which increases power consumption, distorts the electrical field, and contributes to electrode breakdown. And since a vacuum of less than $10^{-6}$ torr is generally applied between the anode and cathode substrates the spacers must be strong and numerous to withstand the forces on the substrates. Thus precise spacing is problematic for the triode FED's used in flat panel displays where the anode and cathode are on two different substrates. See, for example, U.S. Pat. No. 4,923,421, by I. Brodie, et al., entitled "Method for Providing Polyimide Spacers in a Field Emission Panel Display".

Thus the above structures and atmospheres are useful for flat panel display applications, but they may be further improved. The field enhancing structures such as conical tips, film edges, whiskers, etc. provide only a low current, high density electron beam. Such beams are not ideally suited for producing luminesence over a large area. Also these structures suffer from uniformity limitations. Triodes are not ideally suited to flat panel displays because they require precise alignment in two planes and the spacers are problematic. Furthermore, none of these structures provide a broad area emission surface to direct electrons laterally to a luminescent anode located, as is desirable for a flat panel display.

SUMMARY OF THE INVENTION

A principal object of the present invention is to provide a means to direct electrons from a broad emission surface to a major portion of a surface of a laterally disposed anode.

Other objects include providing a lateral field emitter device and a method for manufacturing such that the device has uniform field emission, has a large field enhancement factor, requires only a relatively small voltage for field emission to occur, and is suitable for a multicolor array of lateral, luminescent field emitter diodes for use in a full-color flat panel display using low voltage IC drivers.

A feature of the present invention is a lateral field emission diode with a flat substrate made of an insulating material having a layer of a conductive material covering a portion of the substrate, an anode disposed on the layer of conductive material, and a cathode disposed on an insulative layer over the conductive layer, the cathode providing an electron emission surface and being so disposed as to provide a means to direct electrons from the emission surface laterally to the anode.

Another feature of the present invention is providing a lateral field emitter device including a flat substrate which is a transparent insulator. The substrate has a conductive layer covering a portion of the substrate, an anode disposed on the conductive layer, and a cathode disposed on an insulative film which is on the conductive layer. At least one side of the cathode extends upward from the substrate and faces a corresponding side of the anode, which also extends upward from the substrate. These corresponding sides are disposed a uniform distance apart so that the gap between the cathode and anode is uniform. When a certain electrical potential is applied between the anode and the cathode, the cathode emits electrons to the anode along the length of the gap. Upon emission the electrical field imparts a predetermined energy level to the emitted electrons. Also, gases in the gap have an ionization potential above the energy level of the emitted electrons, thus the electrons emitted to the anode do not ionize the gases. Alternatively, a vacuum is provided so that the gases in the gap have a certain density. That density is less than a predetermined critical density so that the emission surface is preserved despite a small amount of ionization.

Another feature of the present invention in accordance with one embodiment is a method of manufacturing a lateral field emitter device including the steps of (a) providing a substantially flat substrate, (b) disposing a conductive layer on the substrate, (c) disposing an anode material on the conductive layer, (d) positioning an etch mask with an opening therethrough above the anode material such that the anode material beneath the opening is exposed whereas the anode material beneath the mask is covered, (e) etching the anode material beneath the opening wherein the etching undercuts the anode material beneath the mask thereby forming an anode sidewall beneath the mask, exposing the conductive layer beneath the opening and exposing the conductive layer beneath the mask adjacent the anode sidewall, (f) depositing an insulative film on the conductive layer beneath the opening without depositing the insulative film on the anode sidewall thereby forming an insulative film sidewall defined by the opening, (g) depositing a cathode material on the insulative film beneath the opening without depositing the cathode material on the anode sidewall thereby forming a cathode sidewall defined by the opening and a substantially uniform gap between the anode sidewall and the cathode sidewall wherein the cathode material has a bottom surface between a top and bottom surface of the anode material, and (h) removing the mask.

A further feature of the present invention in accordance with another embodiment is a method of manufacturing a lateral field emitter device that is similar to the above method, but which enables a smaller gap while requiring more steps. This method includes the steps of (a) providing a substantially flat substrate, (b) disposing a conductive layer on the substrate, (c) disposing an anode material on the conductive layer, (d) positioning an etch mask with an opening therethrough above the anode material such that the anode material beneath the opening is exposed whereas the anode material beneath the mask is covered, (e) etching the anode material beneath the opening thereby forming an anode sidewall defined by the opening and exposing the conductive layer beneath the opening, (f) depositing an insulative film on the conductive layer beneath the opening and on the entire anode sidewall thereby forming an insulative film sidewall with a lower portion adjacent the conductive layer and an upper portion adjacent the opening, (g) depositing a cathode material on the insulative film on the conductive layer beneath the opening and on the lower portion of the insulative film sidewall without depositing the cathode material on the upper portion of the insulative film sidewall thereby forming a cathode sidewall adjacent the lower portion of the insulative film sidewall wherein the cathode material has a bottom surface between a top and bottom surface of the anode material, (h) removing the upper portion of the insulative film sidewall, (i) removing the mask, and (j) removing the lower portion of the insulative film sidewall thereby forming a substantially uniform gap between the anode sidewall and the cathode sidewall.

In another feature of the present invention, either of the above methods may further include providing the anode and the cathode in fork shapes disposed so that they interleave to form a rectangle. Additionally, the interleaving shapes may be arranged so that at least 50% of the area of the resulting rectangular field emitter is capable of luminescing.

A still further feature of the present invention is a method of manufacturing an entire array of lateral field emitter devices. The field emitter devices in the array may be of varied luminescent colors so that they may be used in a full-color, flat panel display. In order to make the array, the step of depositing the anode material is altered and repeated.

The present invention makes use of thin film technology principles which have been known and studied for many years and published in several books. See, for example, Maissel and Glang, *Handbook of Thin Film Technology,* 1983 Reissue, McGraw-Hill Book Company, which is incorporated herein by reference.

An advantage of the present invention is that it provides an efficient method of manufacturing a small gap between the anode and the cathode of a field emitter which does not require high resolution photoreduction.

Another advantage is that it provides a method of manufacturing a field emitter which does not require accurately aligning elements of the device in two planes.

A still further advantage is a relatively low temperature method of manufacturing which can be performed without melting a glass substrate (melting point approximately 500° C.).

A still further advantage is that it provides a low cost, high yield method for manufacturing an array of field emitter devices for large area (10 inch diagonal or greater) flat panel displays on a single substrate using standard semiconductor technologies.

These and other objects, features, and advantages of the present invention will be further described and more readily apparent from a review of the detailed description and preferred embodiments which follow.

BRIEF DESCRIPTION OF THE DRAWINGS

The following detailed description of the preferred embodiments can best be understood when read in conjunction with the accompanying drawings, wherein.

DETAILED DESCRIPTION OF THE PREFERRED EMBODIMENTS

Figure 1:
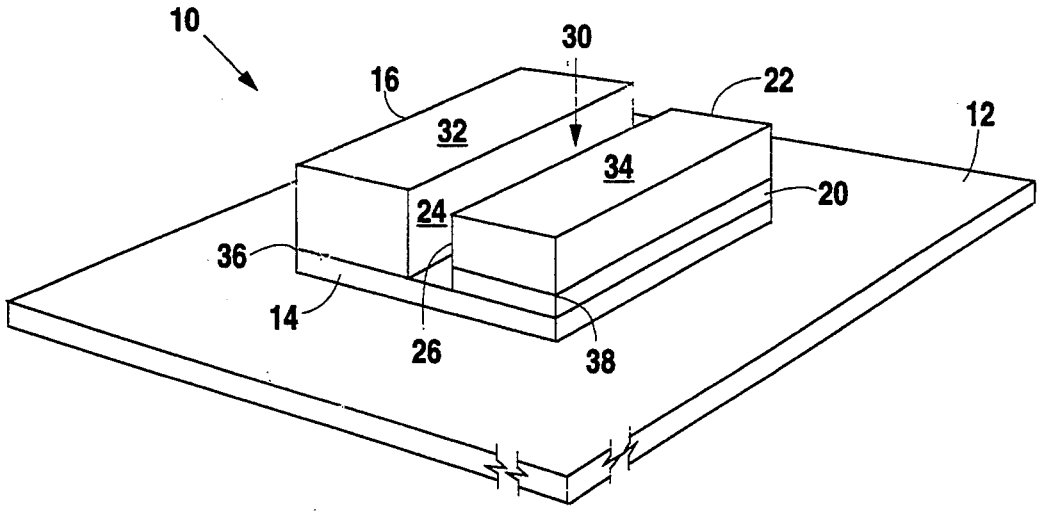
FIG. 1 shows a perspective view of a lateral field emitter device of the present invention having an anode and cathode disposed side by side.

In the accompanying drawings similar elements are designated by the same reference numeral throughout the several views. Elements depicted are not necessarily shown to scale.

Referring to FIG. 1, there is shown a field emitter device 10. At the base of device 10 is a flat substrate 12. A portion of substrate 12 is covered by an electrically conductive layer 14. Disposed on conductive layer 14 is anode 16. Disposed on another portion of conductive layer 14 is electrically insulative layer 20, upon which is disposed cathode 22. Anode 16 has a flat side 24 which extends orthogonally upward from the top surface of substrate 12. Likewise, cathode 22 has a flat side 26 which extends orthogonally upward from the top surface of substrate 12. Side 24 of anode 16 is spaced from and parallel to corresponding side 26 of cathode 22. As a result, gap 30 extends above conductive layer 14 between anode side 24 and cathode side 26. As also seen, top surface 32 of anode 16 extends above top surface 34 of cathode 22, and bottom surface 36 of anode 16 extends below bottom surface 38 of cathode 22.

Figure 2:
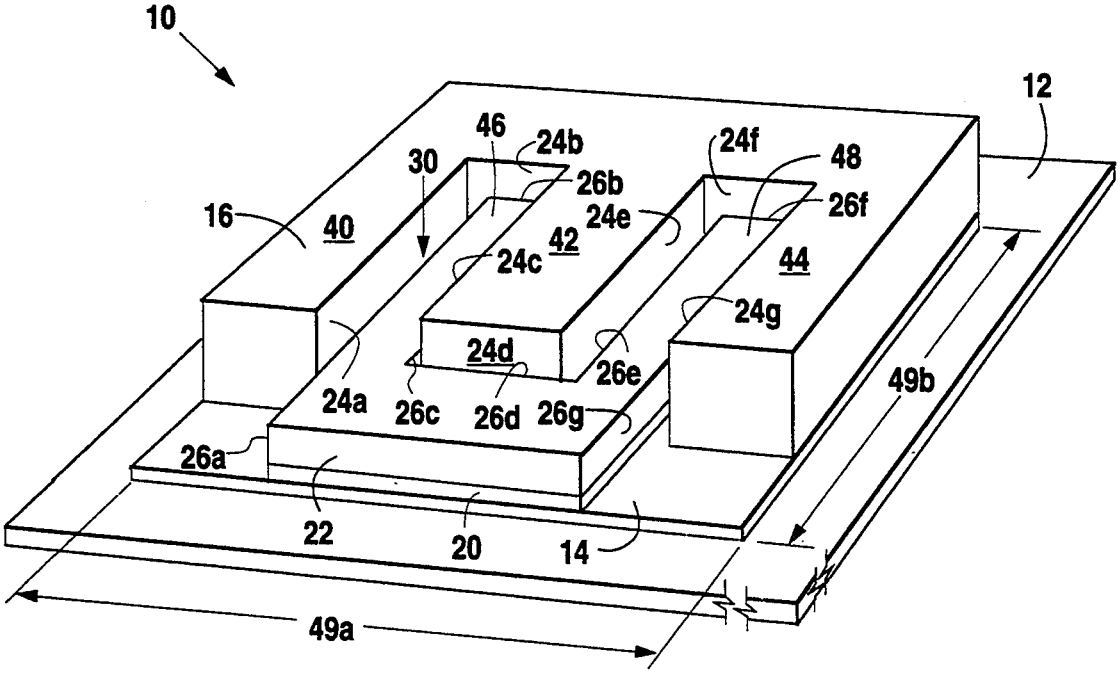
FIG. 2 shows a perspective view of a lateral field emitter device of the present invention having an interleaving, forked-shaped anode and cathode.

Referring to FIG. 2, there is shown another embodiment of field emitter device 10 with an interleaving, fork-shaped anode and cathode configuration. In this embodiment, the length of anode legs 40, 42 and 44 exceeds the height of anode 16; likewise, the length of cathode legs 46 and 48 exceeds the height of cathode 22. Anode sides 24*a*, 24*b*, 24*c*, 24*d*, 24*e*, 24*f*, and 24*g* are spaced from and parallel to corresponding cathode sides 26*a*, 26*b*, 26*c*, 26*d*, 26*e*, 26*f*, and 26*g*. The corresponding anode sides 24*a*–24*g* and cathode sides 26*a*–26*g* define gap 30 which is uniform and extends the entire length of anode sides 24*a*–24*g*.

Because of its lateral structure and the long uniform gap between the anode and the cathode, field emitter device 10 is well suited to provide pixel shapes for flat panel displays. The anode and cathode of FIG. 2 form a rectangle having 150 micrometer long sides 49*a* and 49*b*. Such a field emitter device has more than 50% luminescent surface area. The gap 30 may include only gases with ionization potentials of more than 10 volts—for example, air at normal atmospheric pressure. Accordingly, when an electrical potential of 10 volts is applied between the anode and cathode with such a gap the cathode emits electrons which will be imparted an energy level of 10 eV or less. Because the energy level imparted to the emitted electrons is below the ionization potential of the air there is no ionization of gases in the gap. Alternatively, if it is desired to operate the FED at a higher voltage to increase luminescence of the anode, the gap 30 may be evacuated to a pressure of $10^{-6}$ torr or less so that the gases in the gap have a density less than a predetermined critical density. The emission surface will then be preserved despite a small amount of ionization.

Further details of the structure of field emitter device 10 will be described and depicted in the following methods for producing the lateral field emitter device of the present invention.

Referring to FIGS. 3A–3G, there are shown successive cross-sectional views depicting the first stages for partially fabricating field emitter device 10. These first stages are common to a first and second embodiment for fabricating device 10, with the final stages shown in FIGS. 4A–4D and FIGS. 5A–5F, respectively.

Figure 3A:
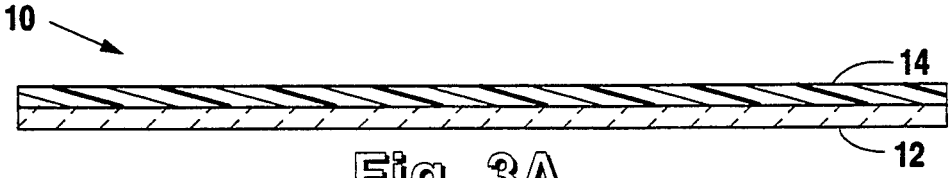
FIGS. 3A–3G show cross-sectional views of successive first stages of fabricating a field emitter device of the present invention.

With reference to FIG. 3A, substrate 12 is provided with conductive layer 14 thereon. Substrate 12 is preferably an insulator such as glass or silicon, or an appropriate metal, although other materials can be used provided they furnish a substantially flat, stable surface upon which a plurality of field effect devices can be fabricated. A continuous, 0.1 micrometer thick conductive layer 14 is disposed on the entire top surface of substrate 12 using thin or thick film deposition techniques. In the event luminescence from the bottom of device 10 is desired, substrate 12 and conductive layer 14 must each be transparent, in which case substrate 12 is preferably glass and conductive layer 14 is preferably indium tin oxide deposited by sputtering or evaporation. If, on the other hand, luminescence from the top of device 10 is desired then conductive layer 14 is preferably a reflective material such as aluminum. If only a single anode and cathode are desired then substrate 12 and conductive layer 14 may be the same conductive material.

Figure 3B:
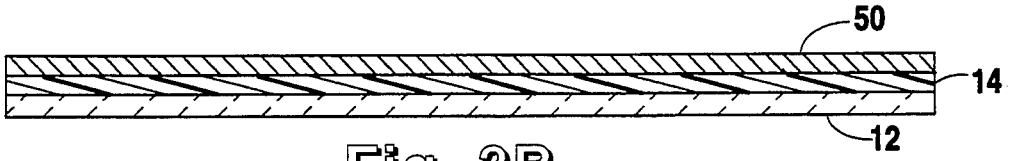

With reference to FIG. 3B, a several micrometer thick continuous layer of photoresist 50 is overlayed on conductive layer 14. Thinner photoresist masks are acceptable provided the film is continuous.

Figure 3C:
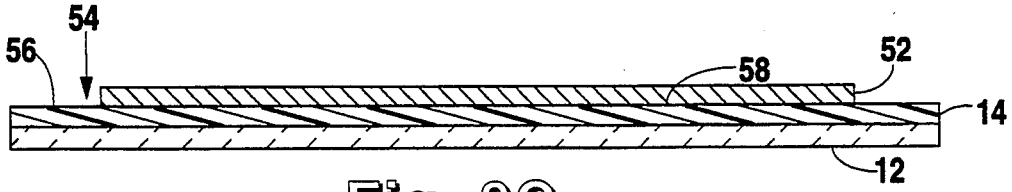

With reference to FIG. 3C, photoresist 50 is patterned through standard lithographic techniques to form photoresist etch mask 52 containing a predetermined pattern of openings 54 thereby exposing portions 56 of conductive layer 14 while covering portions 58 of conductive layer 14.

Figure 3D:
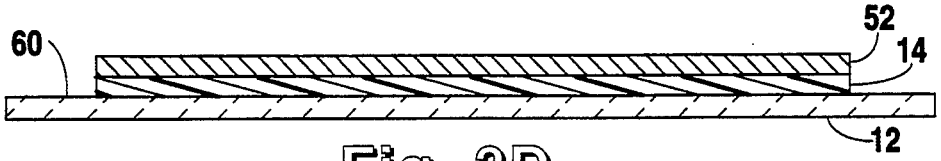

With reference to FIG. 3D, the exposed portions 56 (FIG. 3C) of conductive layer 14 are etched and removed thereby exposing the underlying portions 60 of substrate 12. Any suitable dry or wet chemical etch can be used, as is conventional.

Figure 3E:
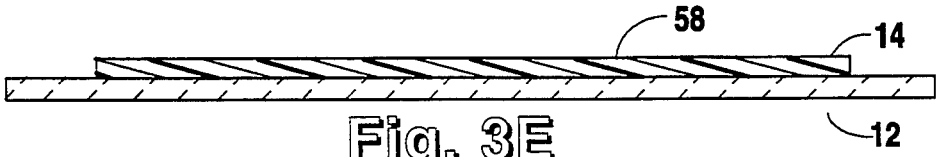

With reference to FIG. 3E, photoresist etch mask 52 (FIG. 3D) is removed, such as by dissolving the mask in a solvent as is well known in the art, thereby exposing unetched portions 58 of conductive layer 14.

Figure 3F:
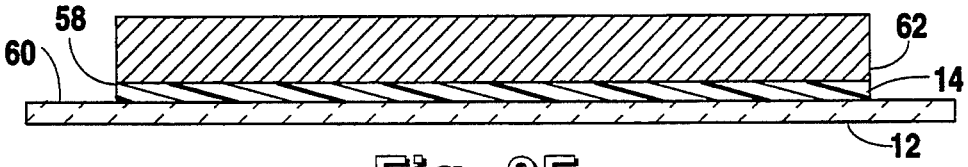

With reference to FIG. 3F, anode material 62 is disposed on conductive layer 14. For instance, anode material 62 may be deposited as a layer 2 micrometers to 10 micrometers thick on the entire unetched portion 58 of conductive layer 14 without being deposited on the exposed portions 60 of substrate 12, for instance using thin or thick film techniques such as sputtering anode material 62 through a patterned metal mask (not shown). Anode material 62 may be a low energy conductive phosphor which emits light upon bombardment by electrons, preferably with energy of approximately 400 electron-volts or less. (Herein, emitting light due to electron bombardment is referred to as "luminescing".) Suitable low energy phosphors include ZnO:Zn, ZnCd:Ag, and ZnS:Ag,Al.

Figure 3G:
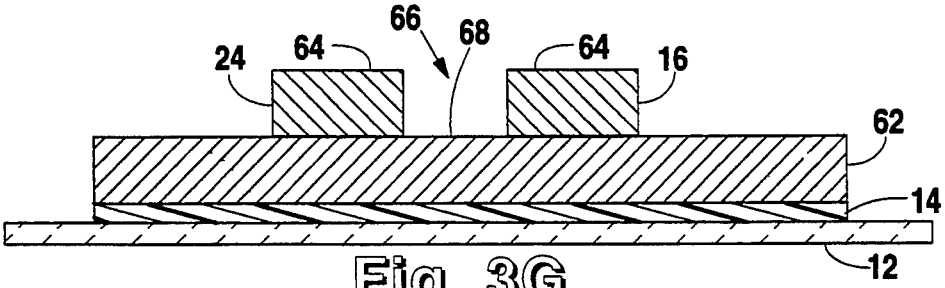

With reference to FIG. 3G, using the photolithographic method described in FIGS. 3B and 3C above, a second etch mask, shown as photoresist etch mask 64, is overlayed on anode material 62. Etch mask 64 is patterned with openings 66 exposing portions 68 of anode material 62. For example, to obtain the fork-shaped anode of FIG. 2, mask 64 would be similarly patterned.

It should be understood that the anode material and conductive layer are not normally etched and patterned in the same step since the conductive layer typically includes interconnecting portions outside the anode material. Furthermore, if a full-color flat panel display is desired then the steps in FIGS. 3F and 3G can be performed in sequence three times to selectively pattern three different anode materials. This may include depositing a discontinuous layer of red, blue and green phosphor on different portions of the conductive layer.

As mentioned above, FIGS. 3A–3G provide the first stages for fabricating a field emitter device in accordance with a first and second embodiment of the present invention. The second stages of the first embodiment are shown in FIGS. 4A–4D; the second stages of the second embodiment are shown in FIGS. 5A–5F. The field emitter devices produced in the first and second embodiments have similar structures except the gap between the anode and the cathode in the second embodiment may be relatively smaller.

Figure 4A:
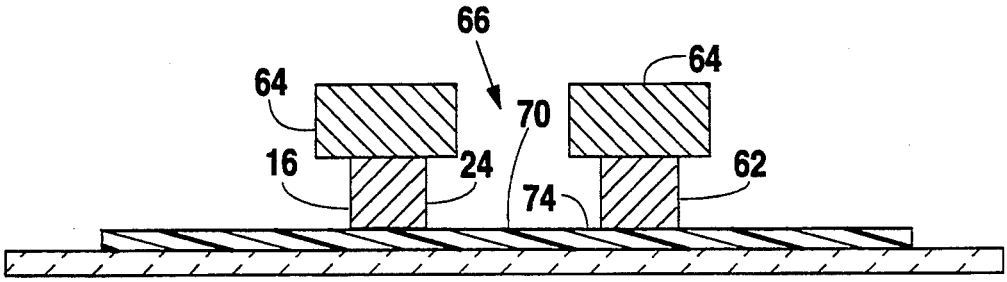
FIGS. 4A–4D show cross-sectional views of successive second stages of fabricating a field emitter device of the present invention in accordance with a first embodiment.

With reference to FIG. 4A, the exposed portions 68 (FIG. 3G) of anode 62 are etched, preferably in wet chemicals, thereby exposing first portions 70 of conductive layer 14 directly beneath mask openings 66. In addition, the etch is a side-etching process that undercuts sides 24 of anode material 62 thereby forming anodes 16 beneath mask 64 and exposing second portions 74 of conductive layer 14 beneath mask 64. Thus, second conductor portions 74 are adjacent to anode sides 24. Second conductor portions 74 are preferably 0.8 micrometer to 1.2 micrometer in length and define the lateral location of gap 30 between anode 16 and cathode 22.

Figure 4B:
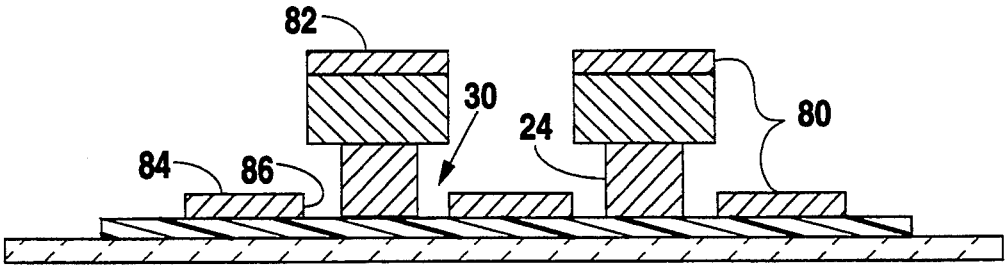

With reference now to FIG. 4B, an electrically insulative film 80 is deposited on device 10, including the top surfaces of mask 64 and first portions 70 of conductive layer 14. However, insulative film 80 is not deposited on a substantial portion of anode sides 24 or second conductor portions 74, which remain "shielded" by mask 64. Preferably, essentially no portion of anode sides 24 or second conductor portions 74 are contacted by insulative film 80 and gap 30 remains substantially uniform. In addition, insulative film 80 must not provide step coverage or "bridges" between upper insulative film 82 on mask 64 and lower insulative film 84 on first conductor portions 70. Thus, insulative film portions 82 and 84 are spaced apart and separate from one another. As a result, sides 86 of lower insulative film 80 are spaced from anode sides 24 by gap 30. Preferably, insulative film 80 is approximately 1 micrometer thick and is deposited by a thin film physical vapor deposition technique such as sputtering or evaporation through a metal mask (not shown). Preferred materials for insulative film 80 include silicon dioxide ($SiO_2$) or silicon nitride ($Si_3N_4$).

Figure 4C:
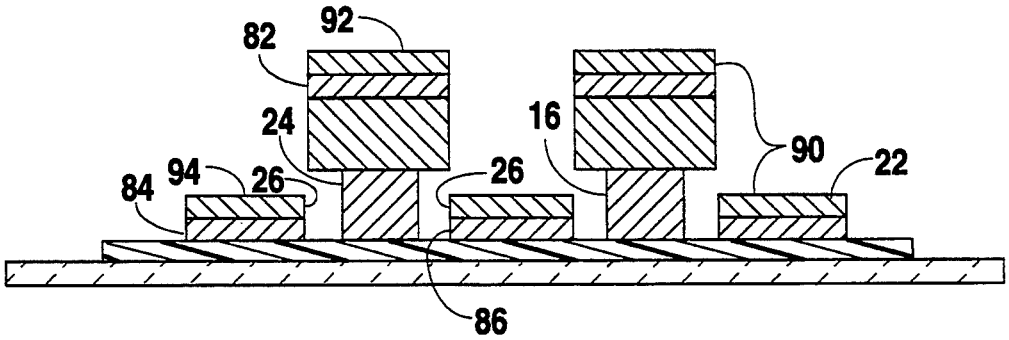

With reference now to FIG. 4C, a layer of cathode material 90 is deposited on device 10, including the top surfaces of upper insulative film 82 and lower insulative film 84. As a result, cathodes 22 are disposed on lower insulative film 84. Cathode material 90 may be deposited by a thin film physical vapor deposition technique such as sputtering or evaporation through a metal mask (not shown). Suitable cathode materials include molybdenum, tungsten, diamond or cermet. The use of diamond as a cathode material is disclosed in U.S. Pat. No. 5,199,918 by N. Kumar, entitled "Method of Forming Field Emitter Device With Diamond Emission Tips" and in U.S. Pat. No. 5,180,951 by L. Dworsky, et al., entitled "Electron Device Electron Source Including Polycrystalline Diamond"; cermet cathode materials are described in U.S. Pat. No. 4,663,559 by A. Christensen, entitled "Field Emission Device" A diamond cathode material may be deposited, for instance, as disclosed in U.S. Pat. No. 5,098,737 to C. Collins, et al., entitled "Amorphic Diamond Material Produced By Laser Plasma Deposition", and in U.S. Pat. No. 4,987,007 to S. Wagal et al., entitled "Method And Apparatus For Producing A Layer Of Material From A Laser Ion Source." Preferably, the thickness of cathodes 22 is no more than approximately 10% of the thickness of lower insulative film 84, and the combined thickness of cathodes 22 and lower insulative film 84 is no more than 80% of the thickness of the anodes 16. Cathode material 90, like insulative film 80, should not spread or provide step coverage so as to interfere with gap 30. That is, cathode material 90 is not deposited on a substantial portion of anode sides 24 or second conductor portions 74, which remain "shielded" by mask 64 and upper insulative layer 82. Preferably, essentially no portion of anode sides 24 or second conductor portions 74 are contacted by cathode material 90, cathode sides 26 and insulating film sides 86 are substantially aligned, and gap 30 remains substantially uniform. In addition, cathode material 90 should not spread or provide step coverage ("bridges") between the cathode material on mask 64 and the cathode material on first conductor portions 70. As is seen, upper and lower cathode material 92 and 94, respectively, are spaced and separate, and are deposited on upper and lower insulative film 82 and 84, respectively. In addition, sides 26 of cathodes 22 are spaced from anode sides 24 by gap 30. In this manner, a gap of approximately 1.0 micrometer is readily provided.

Figure 4D:
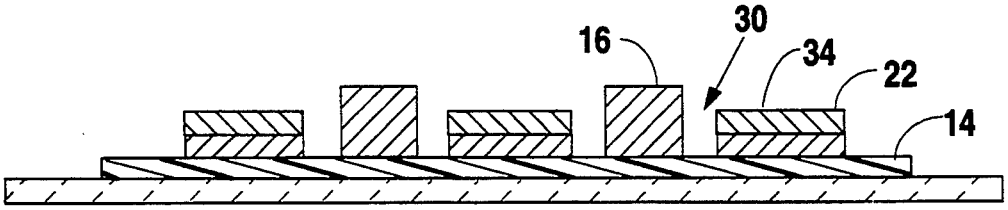

With reference now to FIG. 4D, mask 64 is stripped and removed, for instance by dissolving mask 64 in a solvent. This "liftoff" of mask 64 also removes upper insulative film 82 and upper cathode material 92 thereon. The completed field emitter device 10 thus includes cathodes 22 disposed on lower insulative layer 84 and laterally separated from anodes 16 by gap 30 extending from exposed portions of conductive layer 14 to top surface 34 of cathodes 22.

FIGS. 5A–5F show cross-sectional views of successive second stages of fabricating a field emitter device in accordance with a second embodiment of the present invention.

Figure 5A:
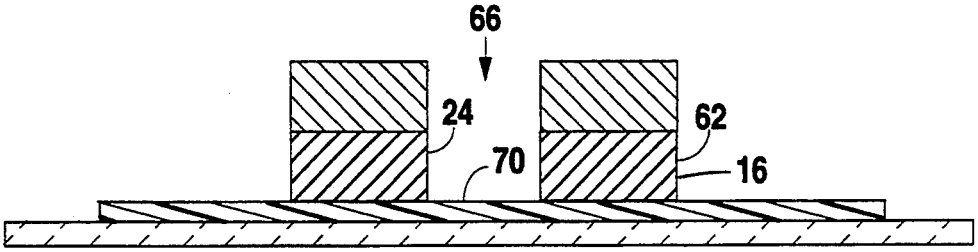
FIGS. 5A–5F show cross-sectional views of successive second stages of fabricating a field emitter device of the present invention in accordance with a second embodiment.

With reference now to FIG. 5A, the exposed portions 68 (FIG. 3G) of anode material 62 are etched away to form sides 24 of anodes 16 directly beneath openings 66. (Unlike the first embodiment, the etch need not and preferably does not undercut the sides of the anode material beneath the mask.) As a result, portions 70 of conductive layer 14 beneath mask openings 66 are exposed whereas the portions of layer 14 beneath mask 64 remain covered by anode material 62. Anisotropic dry etching is preferred to assure anode sides 24 correspond directly to mask openings 66.

Figure 5B:
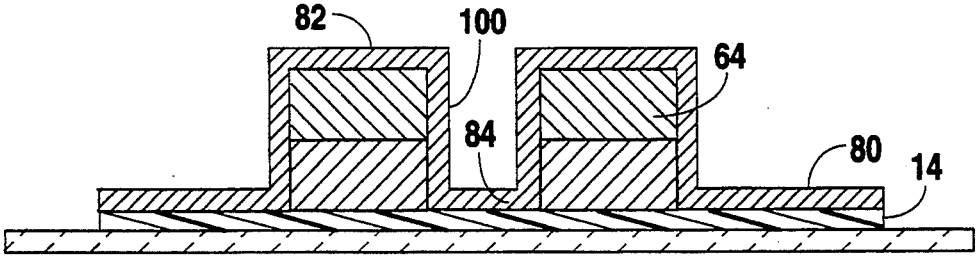

With reference now to FIG. 5B, a continuous layer of insulative film 80 is deposited over the entire device. (Unlike the first embodiment, insulative film 80 completely covers anode sides 24 and extends through openings 66.) As is seen, in the second embodiment insulative film 80 not only includes upper and lower insulative film 82 and 84, respectively, but also insulative film sidewalls 100 extending from conductive layer 14 to the top of mask 64. Thus, in sharp contrast to the first embodiment, insulative film 80 not only contacts anode sides 24 but covers all of anode sides 24. Therefore, in FIG. 5B insulative film 80 is preferably deposited by plasma enhanced chemical vapor deposition (as opposed to sputtering or evaporation as in FIG. 4B) to assure proper step coverage.

Figure 5C:
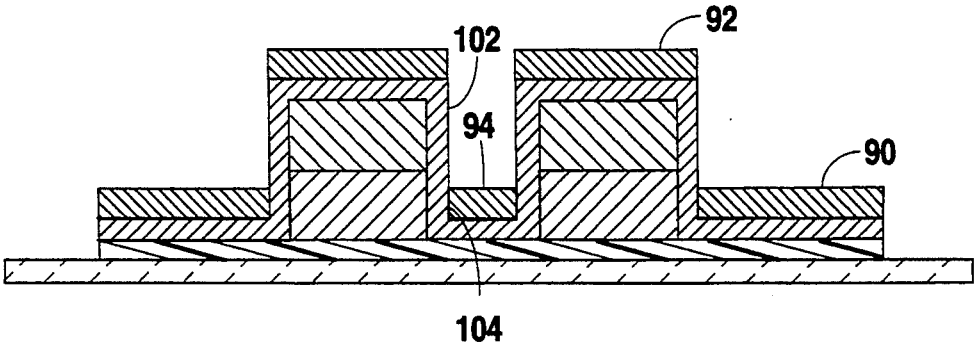

With reference now to FIG. 5C, cathode material 90 is deposited on device 10. (Unlike the first embodiment, cathode material 90 does not correspond to openings 66 due to insulative film sidewalls 100 therein.) As may be seen, in the second embodiment cathode material 90 does not cover all of insulating film 80. That is, upper portion 102 of insulating film sidewalls 100 between upper cathode material 92 and lower cathode material 94 remains exposed. However, lower portion 104 of insulating film sidewalls 100 is sandwiched between anode sides 24 and cathode sides 26. Thus, in the second embodiment, lower insulating film sidewall portion 104 shall define gap 30.

Figure 5D:
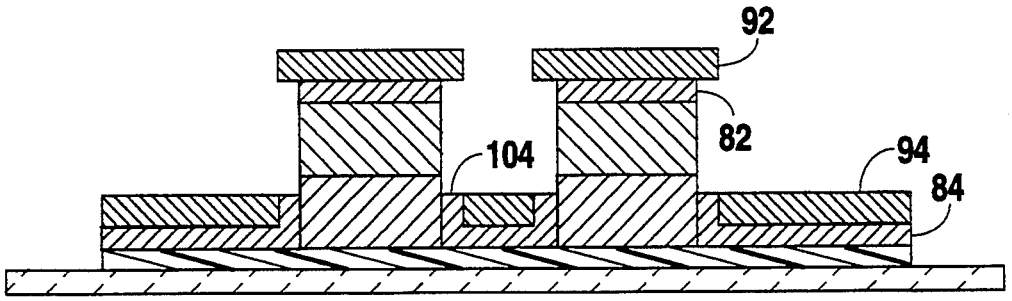

With reference now to FIG. 5D, upper insulating film sidewall portion 102 is removed, such as by wet chemical etching. Upper cathode material 92, however, covers and protects upper insulating film 82. Likewise, lower cathode material 94 covers and protects lower insulating film 84. Furthermore, little or none of lower insulating film sidewall portion 104 is removed in this step.

Figure 5E:
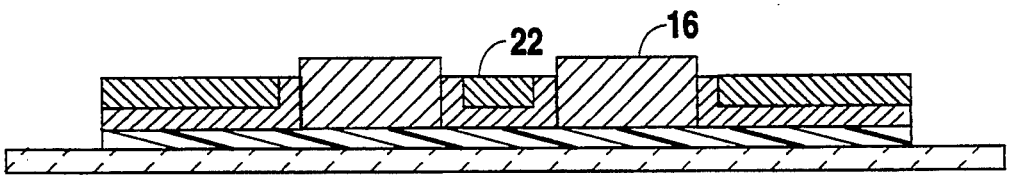

With reference now to FIG. 5E, mask 64 is stripped and removed, for instance by dissolving the mask in a solvent. This liftoff step also removes layers 82 and 92 on mask 64. Such liftoff would be difficult or impossible if upper insulating film sidewall 102 were to remain on device 10 since sidewall 102 would shield mask 64 from the etch as well as clamp mask 64 to device 10.

Figure 5F:
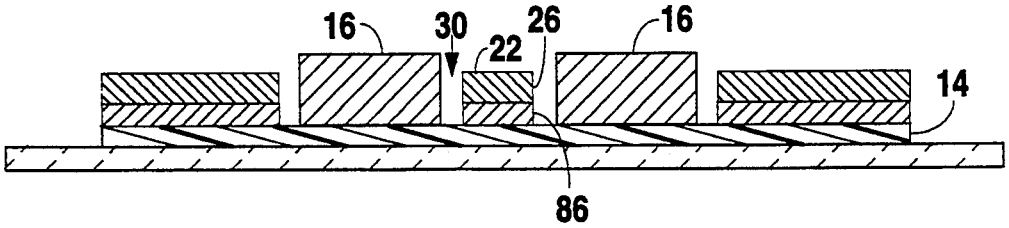

With reference now to FIG. 5F, lower insulating film sidewall portion 104 is stripped and removed, such as by wet chemical etching, thereby creating gap 30 between anode sides 24 and cathode sides 26. It is understood that similar wet chemical etchants may be used in FIGS. 5D and 5F. Preferably, cathode sides 26 and insulating film sides 86 are substantially aligned, and gap 30 remains substantially uniform extending from exposed portions of conductive layer 14 to top surface 34 of cathodes 22.

Thus it may be seen that the completed field emitter device 10 fabricated in accordance with the first embodiment (FIGS. 3A–3G and 4A–4D) has a structure similar to the completed device fabricated in accordance with the second embodiment (FIGS. 3A–3G and 5A–5F). However, the size of the gap 30 provided in the first embodiment (FIG. 4A) is determined by the depth of the undercutting beneath the mask, whereas the size of the gap 30 provided in the second embodiment (FIG. 5B) is determined by the thickness of vertical sidewalls 100 of insulative film 80. Therefore, the second embodiment may provide a smaller gap than the first embodiment, although the second embodiment requires more steps than the first embodiment to produce the finished field emitter device.

It should therefore be appreciated that the above methods provide economical, high yielding manufacture of laterally disposed field emitter diodes which are well suited for use in flat panel displays. Multiple alignment steps are unnecessary. In addition, the small gap between the anode and cathode is provided without the need for precisely aligning the anode above the cathode.

Figure 6A:
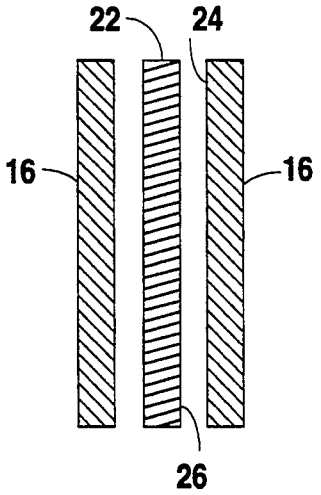
FIGS. 6A–6C show enlarged top plan views of the field emitter device of the present invention with flat and serrated sidewalls defining the gap between the anode and the cathode.
Figure 7A:
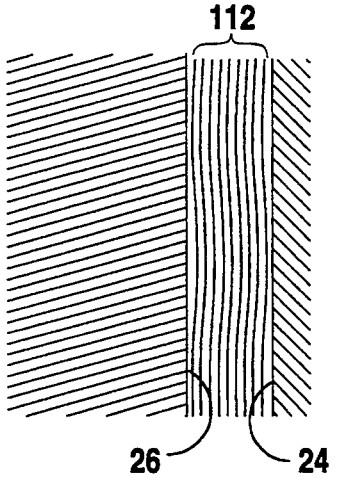
FIGS. 7A–7C shown enlarged top plan views of a portion of the field emitter device of FIGS. 6A–6C illustrating calculated lines of equal potential between the anode and the cathode.
Figure 6B:
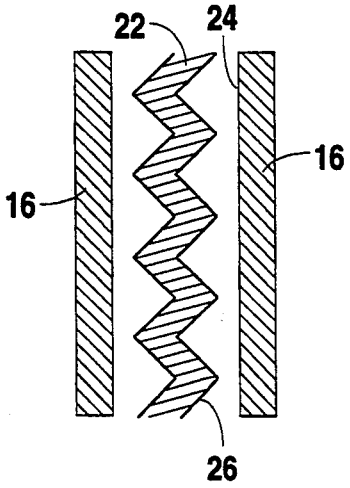
Figure 7B:
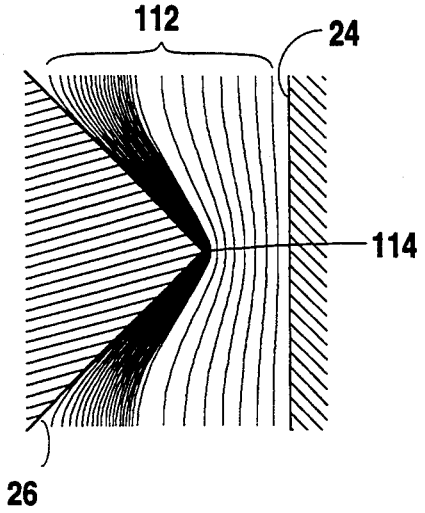
Figure 6C:
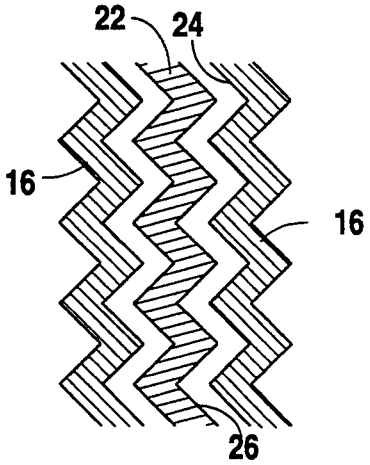
Figure 7C:
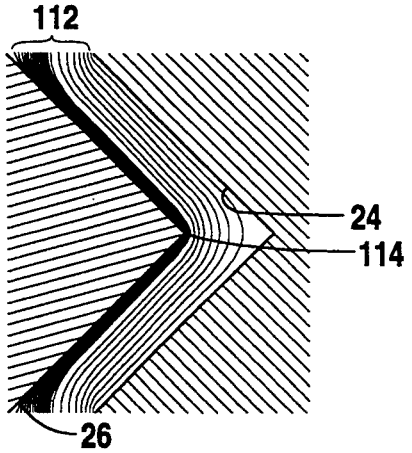

FIGS. 6A–6C show enlarged top plan views of a portion of field emitter 10 in which anode sides 24 and cathode sides 26 assume various shapes. The shapes of sides 24 and 26 may be provided by appropriate patterning of mask 64 according to the step depicted in FIG. 3G. FIGS. 7A–7C illustrate calculated lines of equal electrical potential across a portion of gap 30 in FIGS. 6A–6C, respectively.

In FIG. 6A, there is shown an enlarged plan view of a portion of field emitter device 10 wherein anode sides 24 and cathode sides 26 are substantially flat (stripes). In FIG. 6B, anode sides 24 are flat but cathode sides 26 are serrated (wedge-shaped). In FIG. 6C, sides 24 and 26 are each serrated in a matching pattern. As is seen, gap 30 is substantially uniform in FIGS. 6A and 6C, but is not substantially uniform in FIG. 6B. In FIG. 7A, equal potential lines 112 are uniformly spaced as is expected given the flat surfaces in FIG. 6A; however, in FIG. 7B and in FIG. 7C the equal potential lines 112 converage toward point 114, thereby increasing the concentration of the electric field along the serrated cathode sidewall 26 and increasing the field enhancement factor for device 10. An increased field enhancement factor may reduce or eliminate the need for a low work function cathode material thereby expanding the scope of cathode materials suitable for the present invention. On the other hand, low work function materials such as diamond or cermets may provide suitable cathodes with flat surfaces. While an increased field enhancement factor is generally desirable, forming serrated sides 24 and/or 26 as compared to flat sides will typically require smaller photolithography resolution for mask 64. For example, photolithography resolution of 25 micrometers may be small enough for forming flat sides but too large for forming serrated sides.

Figure 8:
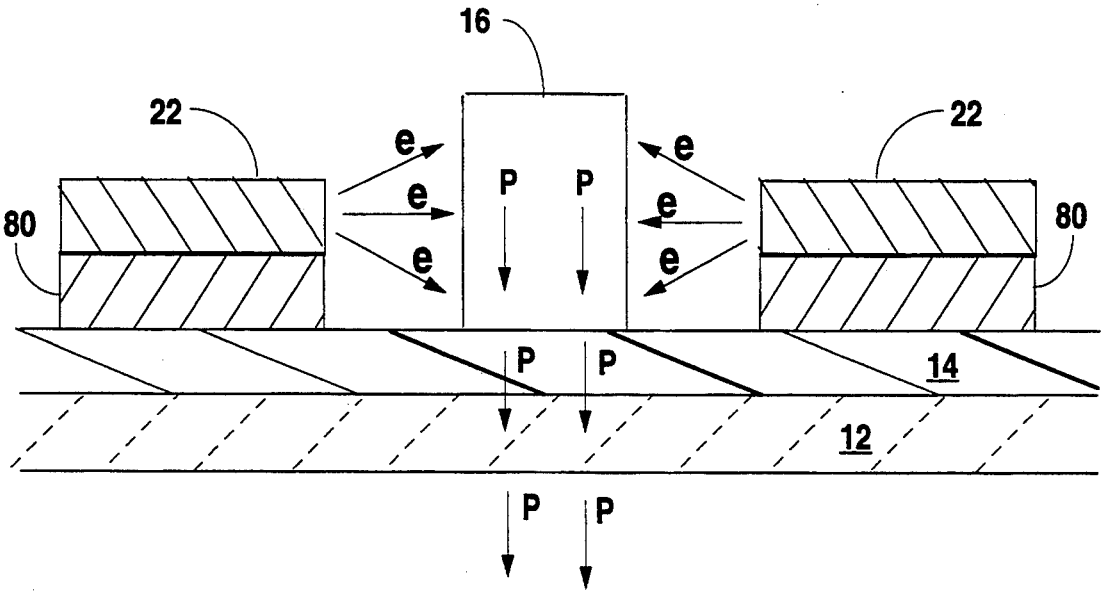
FIG. 8 shows a cross-sectional view of the field emitter device of the present invention illustrating a stream of electrons and photons during operation.

Referring now to FIG. 8, there is shown an enlarged cross-sectional view of device 10 during operation. As is seen, a stream of electrons "e" is emitted from cathode 22 across gap 30 to a major portion of surface 24 of anode 16. Furthermore, in this instance anode 16 is a phosphor, substrate 12 and conductive layer 14 are transparent, and a stream of photons "p" generated by anode 16 flows through conductive layer 14 and substrate 12, respectively, thereby producing luminescence from the bottom of device 10.

Figure 9:
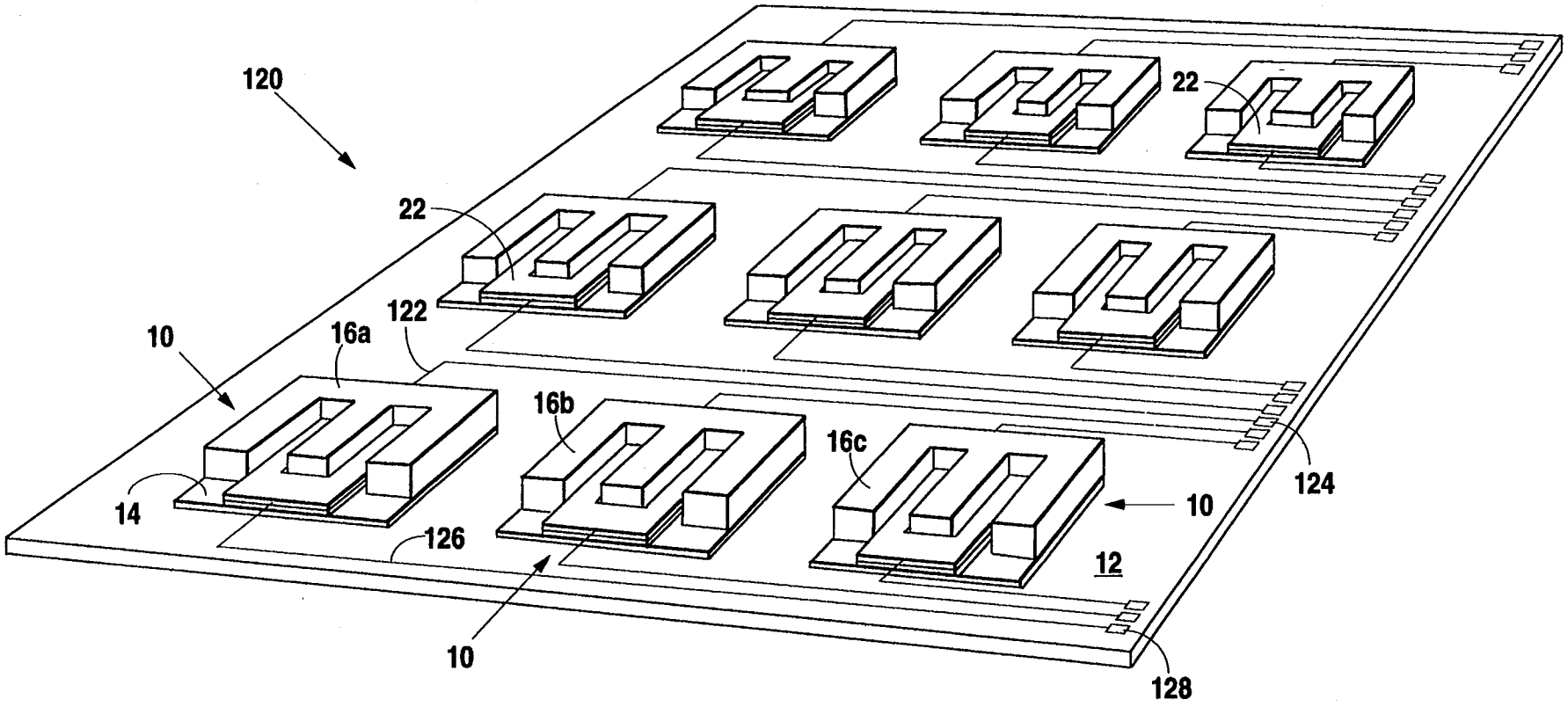
FIG. 9 shows an elevated perspective view of an array of the fork-shaped field emitter devices of FIG. 2.

Referring now to FIG. 9, there is shown an array 120 of the field emitter devices 10 having anodes 16 of varied phosphor materials, including ZnCd:Ag, a red phosphor **16*a*; ZnS:Ag,Al, a blue phosphor 16b; and ZnO:Zn, a green phosphor 16*c*. Conductive lines 122 connect anodes 16 to bonding pads 124. Likewise conductive lines 126 connect cathodes 22 to bonding pads 128. Bonding pads 126 and 128 are adapted to be connected to other electronic components (e.g., low voltage IC drivers) in a flat panel display. Array 120** may itself define a single pixel which may be repeated in matrix organization to provide a full-color display. Since the present method does not require precise alignment in two planes to obtain a small gap between the anode and the cathode it is particularly well suited for producing large area flat panel displays.

The present invention is therefore well adapted to carry out the objects and attain the ends and advantages mentioned, as well as others inherent therein. While presently preferred embodiments of the invention have been described for the purpose of disclosure, numerous other changes in the details of construction, arrangement of parts, compositions and materials selection, and processing steps can be carried out without departing from the spirit of the present invention which is intended to be limited only by the scope of the appended claims.

What is claimed is:

1. A method of manufacturing a lateral field emitter device, comprising the following steps:

(a) providing a substantially flat substrate;

(b) disposing a conductive layer on the substrate;

(c) disposing an anode material on the conductive layer;

(d) positioning an etch mask with an opening therethrough above the anode material such that the anode material beneath the opening is exposed whereas the anode material beneath the mask is covered;

(e) etching the anode material beneath the opening wherein the etching undercuts the anode material beneath the mask thereby forming an anode sidewall beneath the mask, exposing the conductive layer beneath the opening and exposing the conductive layer beneath the mask adjacent the anode sidewall;

(f) depositing an insulative film the conductive layer beneath the opening without depositing the insulative film on the anode sidewall thereby forming an insulative film sidewall defined by the opening;

(g) depositing a cathode material on the insulative film beneath the opening without depositing the cathode material on the anode sidewall thereby forming a cathode sidewall defined by the opening and a substantially uniform gap between the anode sidewall and the cathode sidewall wherein the cathode material has a bottom surface between a top and bottom surface of the anode material; and (h) removing the mask.

2. The method of claim 1, wherein step (e) includes a wet chemical etch;

step (f) includes depositing a discontinuous layer of the insulative film on the substrate without depositing the insulative material beneath the mask such that a lower layer of the insulative film is disposed on the conductive layer beneath the opening, an upper layer of the insulative film is disposed on the mask, and the upper and lower layers of the insulative film are separate and spaced;

step (g) includes depositing a discontinuous layer of the cathode material on the substrate without depositing the cathode material beneath the mask such that a lower layer of the cathode material is disposed on the lower layer of the insulative film, an upper layer of the cathode material is disposed on the upper layer of the insulative film, and the upper and lower layers of the cathode material are separate and spaced; and step (h) includes lifting off the mask and the upper layers of the insulative film and the cathode material thereon.

3. A method of manufacturing a lateral field emitter device comprising the following steps:

(a) providing a substantially fiat substrate;

(b) disposing a conductive layer on the substrate;

(c) disposing an anode material on the conductive layer;

(d) positioning an etch mask with an opening therethrough above the anode material such that the anode material beneath the opening is exposed whereas the anode material beneath the mask is covered;

(e) etching the anode material beneath the opening thereby forming an anode sidewall defined by the opening and exposing the conductive layer beneath the opening;

(f) depositing an insulative film on the conductive layer beneath the opening and on the entire anode sidewall thereby forming an insulative film sidewall with a lower portion adjacent the conductive layer and an upper portion adjacent the opening;

(g) depositing a cathode material on the insulative film on the conductive layer beneath the opening and on the lower portion of the insulative film sidewall without depositing the cathode material on the upper portion of the insulative film sidewall thereby forming a cathode sidewall adjacent the lower portion of the insulative film sidewall wherein the cathode material has a bottom surface between a top and bottom surface of the anode material;

(h) removing the upper portion of the insulative film sidewall;

(i) removing the mask; and (j) removing the lower portion of the insulative film sidewall thereby forming a substantially uniform gap between the anode sidewall and the cathode sidewall.

4. The method of claim 3, wherein step (e) includes a dry etch;

step (f) includes depositing a continuous layer of the insulative film on the substrate such that the insulative film extends through the opening and covers the mask;

step (g) includes depositing a discontinuous layer of the cathode material on the substrate such that a lower layer of the cathode material is disposed on the conductive layer beneath the opening and on the lower portion of the insulative film sidewall, an upper layer of the cathode material is disposed on the insulative film above the mask, and the upper and lower layers of the cathode material are separate and spaced;

step (h) includes removing the insulative film in the opening and is performed before step (i); and step (i) includes lifting off the mask and the insulative film above the mask and the upper layer of the cathode material thereon.

5. The method of claims 1 or 3 wherein the substrate is a single insulative substrate, the conductive layer is selectively deposited on the substrate, and the anode material is selectively deposited on the conductive layer.

6. The method of claim 5 wherein the anode material is a low energy conductive phosphor.

7. The method of claim 6 wherein the substrate and the conductive layer are transparent thereby allowing luminescence from a bottom surface of the device.

8. The method of claim 6 wherein the substrate is a metal and the conductive layer is reflective thereby allowing luminescence from a top surface of the device.

9. The method of claims 1 or 3 wherein the cathode material has a top surface between the top and bottom surfaces of the anode material.

10. The method of claims 1 or 3 wherein the gap extends to the exposed conductive layer.

11. The method of claims 1 or 3 wherein the gap is substantially uniform.

12. The method of claim 11 wherein the anode sidewall and the cathode sidewall are substantially flat and extend orthogonally above the substrate.

13. The method of claim 11 wherein the anode sidewall and the cathode sidewall are serrated and extend orthogonally above the substrate.

14. The method of claims 1 or 3 wherein the anode sidewall is substantially flat and extends orthogonally above the substrate, and the cathode sidewall is serrated and extends orthogonally above the substrate.

15. The method of claims 1 or 3 wherein the cathode material is selected from the group consisting of diamond, cermet, molybdenum, and tungsten.

* * * * *